US008991624B2

(12) United States Patent
Brozak et al.

(10) Patent No.: US 8,991,624 B2
(45) Date of Patent: Mar. 31, 2015

(54) GREETING CARD HIGHLIGHTER

(71) Applicant: American Greetings Corporation, Cleveland, OH (US)

(72) Inventors: Emory Brozak, Strongsville, OH (US); Anthony J. Santarelli, North Olmsted, OH (US)

(73) Assignee: American Greetings Corporation, Cleveland, OH (US)

( * ) Notice: Subject to any disclaimer, the term of this patent is extended or adjusted under 35 U.S.C. 154(b) by 8 days.

(21) Appl. No.: 13/800,532

(22) Filed: Mar. 13, 2013

(65) Prior Publication Data

US 2014/0054250 A1 Feb. 27, 2014

Related U.S. Application Data

(60) Provisional application No. 61/693,504, filed on Aug. 27, 2012.

(51) Int. Cl.
*A47F 7/14* (2006.01)
*A47F 5/00* (2006.01)

(52) U.S. Cl.
CPC ..... *A47F 7/147* (2013.01); *A47F 5/0025* (2013.01); *A47F 7/145* (2013.01); *A47F 5/0068* (2013.01)
USPC ..... 211/85.26

(58) Field of Classification Search
CPC ..... A47F 7/146; A47F 7/144; A47F 7/145; A47F 5/0846; A47F 7/147; G09F 5/00; G09F 1/10; G09F 7/10
USPC ..... 211/55, 40, 43, 50, 51, 52, 128.1, 211/126.13, 59.3, 104, 105, 201, 202, 7, 211/94.01, 106.01, 54.1, 184, 150, 119.003, 211/72; 40/124, 124.2; 248/441.1, 309.1
See application file for complete search history.

(56) References Cited

U.S. PATENT DOCUMENTS

| | | | | | |
|---|---|---|---|---|---|
| 306,243 | A | * | 10/1884 | Gray | 211/50 |
| 1,594,754 | A | * | 8/1926 | Reines | 108/61 |
| 3,298,538 | A | * | 1/1967 | Ganz et al. | 211/184 |
| 3,905,484 | A | * | 9/1975 | Dean et al. | 211/184 |
| 4,079,841 | A | * | 3/1978 | Castel | 211/131.1 |
| 4,613,047 | A | * | 9/1986 | Bushyhead et al. | 211/55 |
| 4,799,744 | A | * | 1/1989 | Toy | 312/229 |
| 5,085,328 | A | * | 2/1992 | Evenson | 211/55 |
| 5,184,737 | A | * | 2/1993 | Hardy | 211/55 |
| 5,222,609 | A | * | 6/1993 | Eaton | 211/55 |
| 5,339,967 | A | * | 8/1994 | Valiulis | 211/57.1 |
| 5,415,370 | A | * | 5/1995 | Valiulis | 248/220.41 |
| 5,603,415 | A | * | 2/1997 | Balnis, Jr. | 211/40 |
| 5,613,606 | A | * | 3/1997 | Meyer | 206/449 |
| 5,938,048 | A | * | 8/1999 | Carroll et al. | 211/55 |
| 6,213,313 | B1 | * | 4/2001 | Levy | 211/51 |

(Continued)

*Primary Examiner* — Joshua Rodden
*Assistant Examiner* — Hiwot Tefera
(74) *Attorney, Agent, or Firm* — Christine Flanagan

(57) ABSTRACT

The present invention discloses a greeting card highlighter for organizing greeting cards into particularized groupings and displaying the greeting cards on a larger fixture in a manner which attracts the attention of consumers. The greeting card highlighter may contain two or more greeting card pockets which are operative to hold a plurality of greeting cards. The pockets may be arranged in a back-to-back arrangement, perpendicular to the main greeting card display to which the highlighter is attached, so as to attract the attention of consumers walking up or down a greeting card aisle.

17 Claims, 5 Drawing Sheets

(56) References Cited

U.S. PATENT DOCUMENTS

| | | | | |
|---|---|---|---|---|
| 6,412,648 | B1 * | 7/2002 | Woolnough et al. | 211/128.1 |
| 6,530,485 | B1 * | 3/2003 | Weber | 211/55 |
| 6,705,473 | B1 * | 3/2004 | Schlesinger | 211/50 |
| 6,951,290 | B2 * | 10/2005 | Speed | 211/113 |
| 7,775,379 | B2 * | 8/2010 | Hodge | 211/55 |
| 7,909,182 | B2 * | 3/2011 | Maier-Hunke | 211/55 |
| 7,987,999 | B2 | 8/2011 | Weigand | |
| 8,132,679 | B2 * | 3/2012 | Berry et al. | 211/55 |
| 8,136,677 | B2 * | 3/2012 | Brozak et al. | 211/50 |
| 8,172,093 | B1 | 5/2012 | Belk | |
| 2004/0074855 | A1 * | 4/2004 | Wons et al. | 211/55 |
| 2005/0133474 | A1 * | 6/2005 | Nomoto | 211/128.1 |
| 2006/0124565 | A1 * | 6/2006 | Speed et al. | 211/72 |
| 2006/0213851 | A1 * | 9/2006 | Grueneberg | 211/128.1 |
| 2008/0078728 | A1 * | 4/2008 | Hodge | 211/55 |
| 2008/0099500 | A1 * | 5/2008 | Maier-Hunke | 221/92 |
| 2008/0209778 | A1 * | 9/2008 | DaRif et al. | 40/124.2 |
| 2008/0282587 | A1 * | 11/2008 | Pender et al. | 40/124.06 |
| 2010/0236111 | A1 * | 9/2010 | Cheetwood | 40/124 |
| 2011/0126436 | A1 * | 6/2011 | Brozak et al. | 40/124.2 |
| 2012/0318759 | A1 * | 12/2012 | Buettner et al. | 211/55 |

* cited by examiner

GREETING CARD HIGHLIGHTER

RELATED APPLICATIONS

This application claims priority to U.S. Provisional Patent Application No. 61/693,504, filed on Aug. 27, 2012, which is incorporated herein by reference in its entirety.

FIELD OF THE INVENTION

This invention is in the general field of retail merchandise displays, and more specifically, displays for highlighting seasonal consumer products such as greeting card.

BACKGROUND OF THE INVENTION

Greeting cards for various occasions such as birthday, anniversary, wedding, etc. typically have a general location in which they are displayed among various greeting card display fixtures. Due to the large variety of greeting cards that are offered in each category, many times entire display fixtures are dedicated to cards specific to a particular occasion or event. However, some seasonal greeting cards or special product collections don't typically have a specific location or home among the categorized greeting cards on a conventional or generic greeting card fixture. The variety of seasonal or special collection greeting cards offered is much smaller in number than those in the general greeting card categories and as such, they don't have a specific location on such a display where consumers may readily locate them. These greeting cards may become lost or otherwise difficult to locate among the vast number of greeting cards offered on a single greeting card display.

SUMMARY OF THE INVENTION

The present invention discloses a greeting card highlighter for organizing greeting cards into particularized groupings and displaying the greeting cards on a larger fixture in a manner which attracts the attention of consumers. The greeting card highlighter may contain two or more greeting card pockets which are operative to hold a plurality of greeting cards. The pockets may be arranged in a back-to-back arrangement, perpendicular to the main greeting card display to which the highlighter is attached, so as to attract the attention of consumers walking up or down a greeting card aisle.

DETAILED DESCRIPTION OF PREFERRED AND ALTERNATE EMBODIMENTS

The greeting card highlighter 100 (also referred to herein as "highlighter") of the present disclosure and related inventions is typically used in combination with a multi-tiered greeting card display having multiple rows containing greeting card pockets for containing and displaying a plurality of greeting cards. The highlighter 100 can be removably attached to one or more pockets of a greeting card display to highlight one or more sets of greeting cards. Seasonal greeting cards, a new line of greeting cards, or particularly trendy or popular line of greeting cards may be displayed on the highlighter to attract the attention of consumers.

Figure 2:
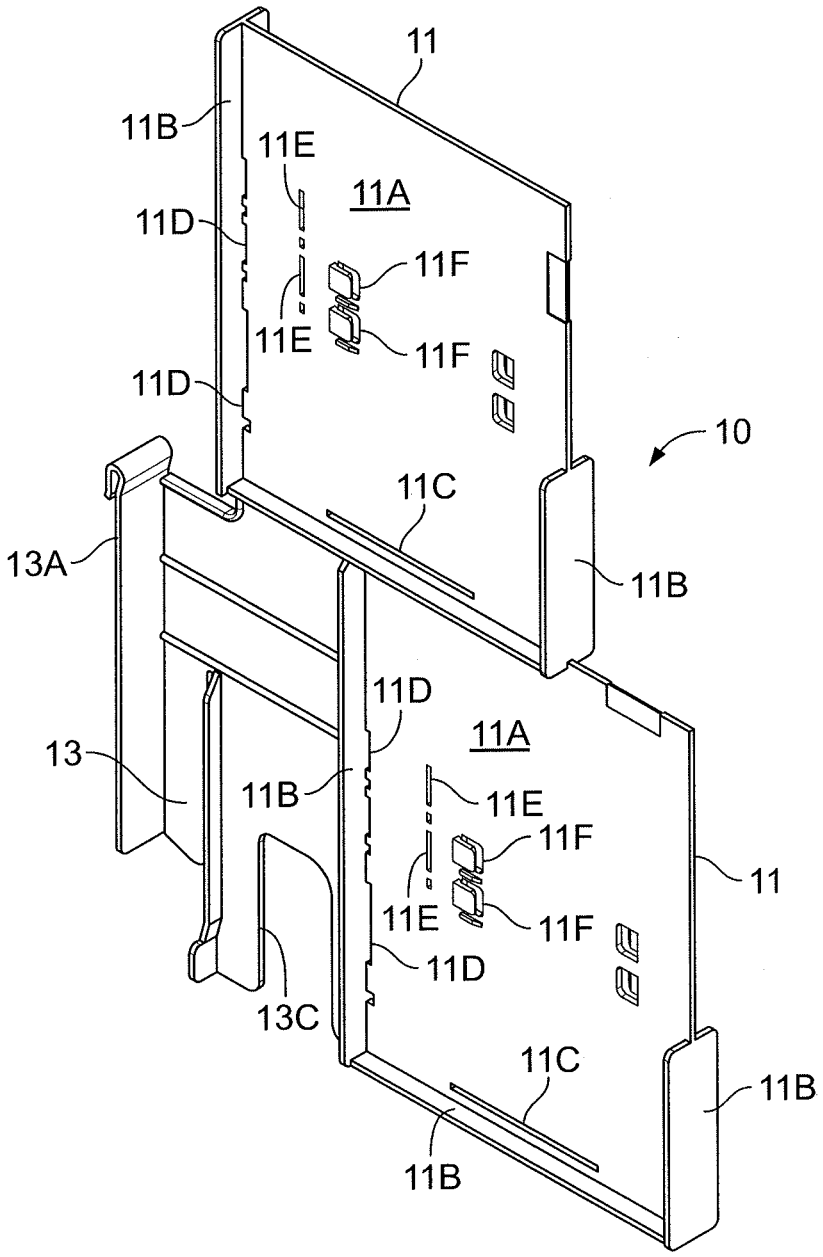
FIG. 2 is a perspective view of the left side of the main panel of the greeting card highlighter of FIG. 1.
Figure 3:
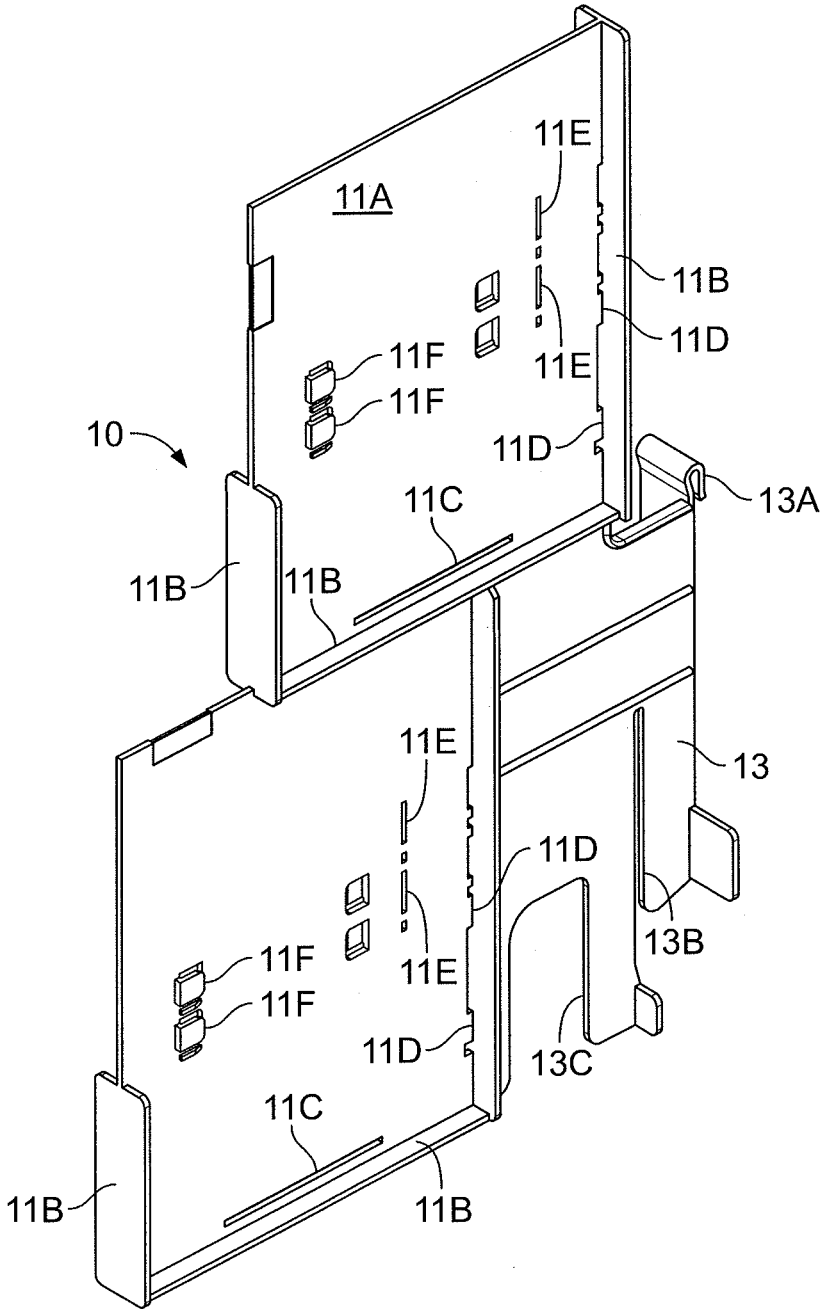
FIG. 3 is a perspective view of the right side of the main panel of the greeting card highlighter of FIG. 1.

The highlighter 100 includes a main panel 10 onto which one or more greeting card pockets 12 are attached, one or more divider clips 14 and one or more gripper channels 16. In a preferred embodiment, the main panel 10, shown in FIGS. 2 and 3, is a single plastic moulded piece having two card backing panels 11 positioned in a staggered arrangement and an attachment portion 13 for facilitating attachment of the highlighter to a larger tiered greeting card display. Each backing panel 10A is double-sided so that each of the features described below as with respect to one side of the channel, exists as a mirror image on the opposite side of the backing panel 10A. In a preferred embodiment, each backing panel 11 is approximately 6.75 inches wide and 9.1 inches tall. The backing panels 11 contain a back panel 11A and three side edge panels 11B which are positioned perpendicular to the back panel 11A. The back panel 11A serves as the back of a greeting card pocket and the three side edge panels 11B serve as support for the floor, and two side walls of a greeting card pocket. Each side panel 11B, in a preferred embodiment, is approximately one-inch wide. The card backing panels 11 also have a horizontal slit or elongate openings 11C proximate to a bottom edge of each card backing panel 11 and two vertical slits or elongate openings 11D, each vertical slit 11D proximate to opposing side edges 11B of the backing panel 11, all of which facilitate attachment of a flexible die cut greeting card pocket 12. Proximate to an inner edge of each backing panel are one or more vertical slits or elongate openings 11E into which a card divider 14 may be inserted. Two clips or channels 11F are moulded into each side of each backing panel 11 with an opening to the left and into which reorder cards or other merchandising materials may be inserted and held at the back of each greeting card pocket. In a preferred embodiment, each clip or channel 11F is approximately 0.4 inches wide. The attachment portion 13 of the main panel 10 is located to adjacent to one backing panel 11B and below the other backing panel 11B. The attachment portion 13 contains a clip 13A arranged perpendicular to the main panel and having a downward facing u-shaped channel which is operative to clip downward onto the front of a larger greeting card tier display. The attachment portion 13 of the main panel 10 additionally contains an elongate vertical slit or channel 13B extending upward from the bottom of the main panel and a larger channel 11C further inward of the vertical slit 13B. The vertical slit 13B allows a portion of the greeting card highlighter 100 to be inserted into the front wall of a greeting card pocket which is located below the greeting card pocket onto which the downward facing u-shaped channel 13A is attached while the larger channel 13C fits over the entire card tier below the greeting card pocket onto which the vertical slit 13B is inserted. In a preferred embodiment, the entire main panel 10 is approximately 11-inches wide and 17-inches tall.

Figure 4:
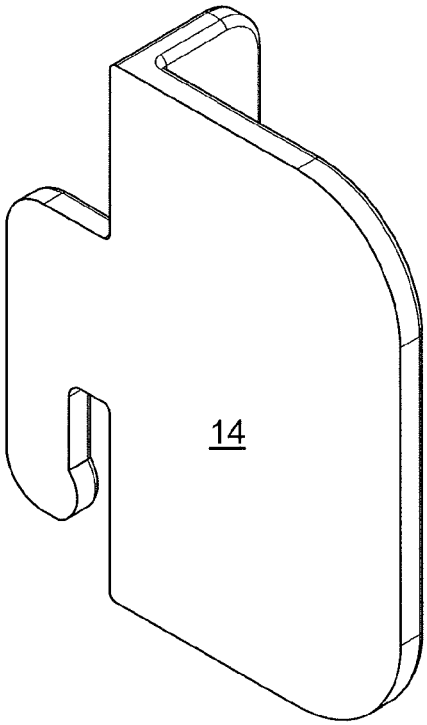
FIG. 4 is a perspective view of a divider clip of the greeting card highlighter of the FIG. 1.

As shown in FIG. 4, a divider clip 14 is an L-shaped attachment having a hook or channel which attaches to one of the vertical slits 11E or openings located proximate to an inner edge of each backing panel 11A. The divider clips 14 are used to narrow the side of the card pocket for greeting cards which are oriented in a traditional portrait position so that the group of greeting cards and envelopes placed therein are not scattered about the pocket but instead neatly contained in a front facing stack. For traditional landscape positioned greeting cards, the divider clip 14 can be easily removed to accommodate the larger width of the greeting card. In a preferred embodiment, each divider clip 14 is approximately 0.7 inches wide and 1.125 inches tall.

Figure 5:
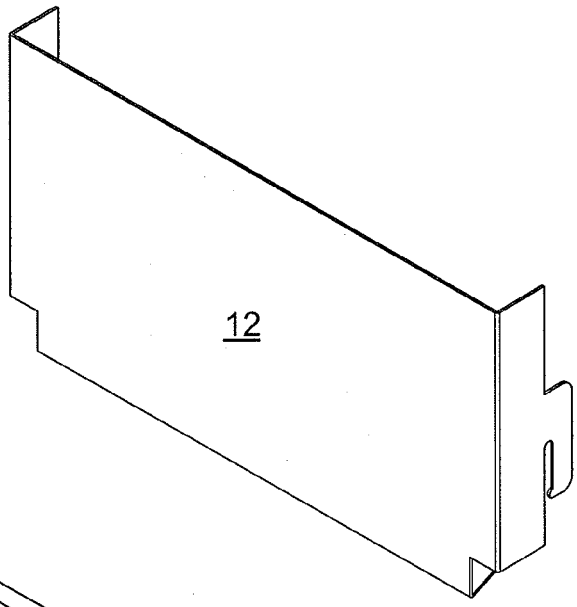
FIG. 5 is a perspective view of a card pocket die cut of the greeting card highlighter of FIG. 1.

A card pocket die cut 12 is shown in FIG. 5. The card pocket die cut 12 is made of a flexible material having three score lines 12A, one score line 12A across the bottom of the die cut and one score line 12A proximate to each side edge of the die cut 12. Each opposing vertical side edge of the die cut contains a slot or hook 12B and the bottom edge contains a tab 12C. When the die cut 12 is folded along each of the three fold lines 12A, the two slots or hooks 12B are inserted into and attached to the vertical slits or openings 11D proximate to each edge of a card backing panel 11A and the tab 12C is inserted into the horizontal slit or opening 11C along the bottom edge of the card backing panel 11. The card backing panel 11 and the folded and attached die cut 12 combine to form a single greeting card pocket. In a preferred embodiment, the entire card pocket die cut 12 is approximately 8.4-inches wide and 4.4-inches tall.

Figure 1:
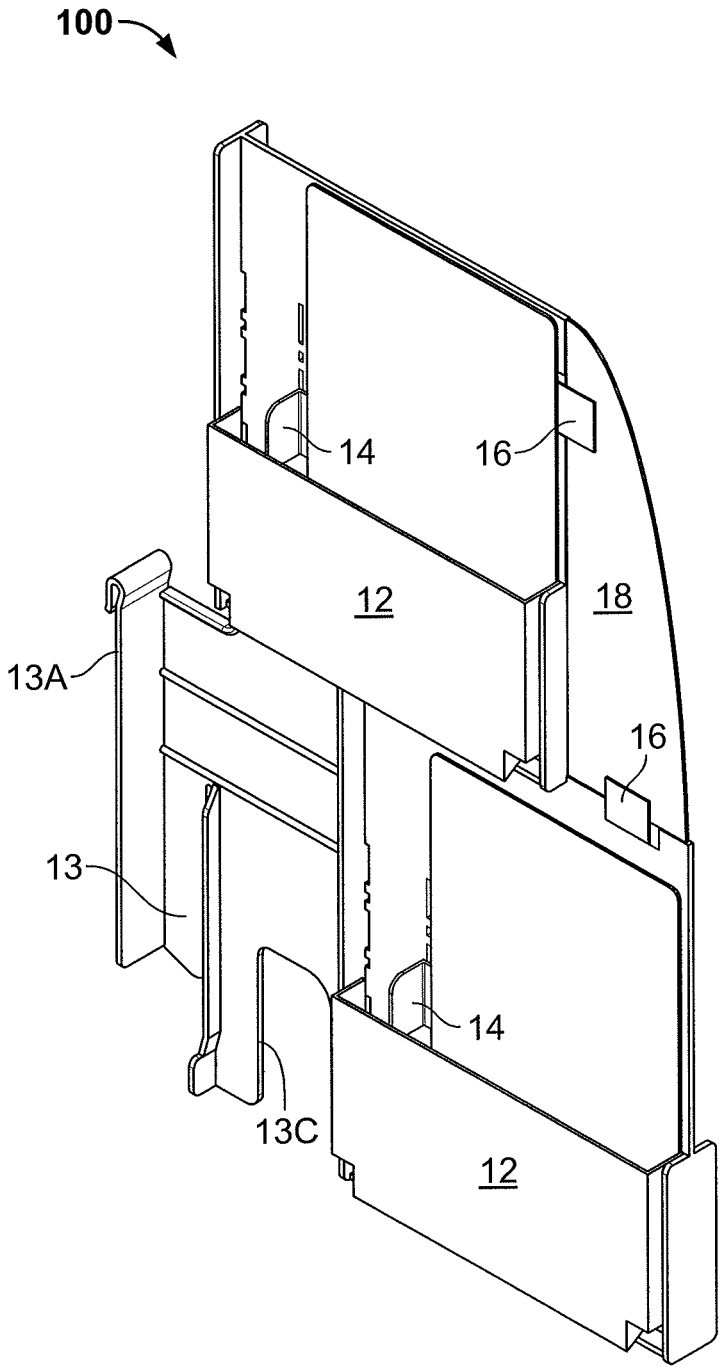
FIG. 1 is a perspective view of the greeting card highlighter of the present invention.
Figure 6:
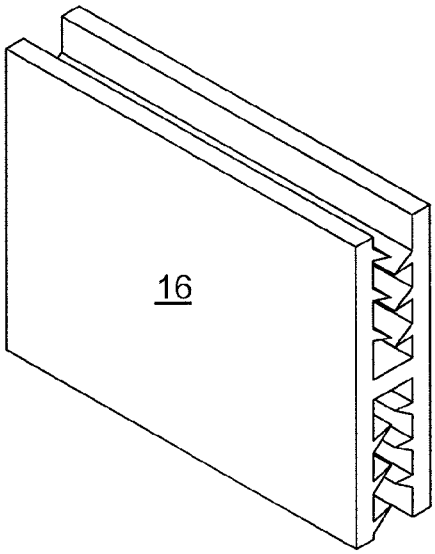
FIG. 6 is a perspective view of a gripper channel of the greeting card highlighter of FIG. 1.
Figure 7:
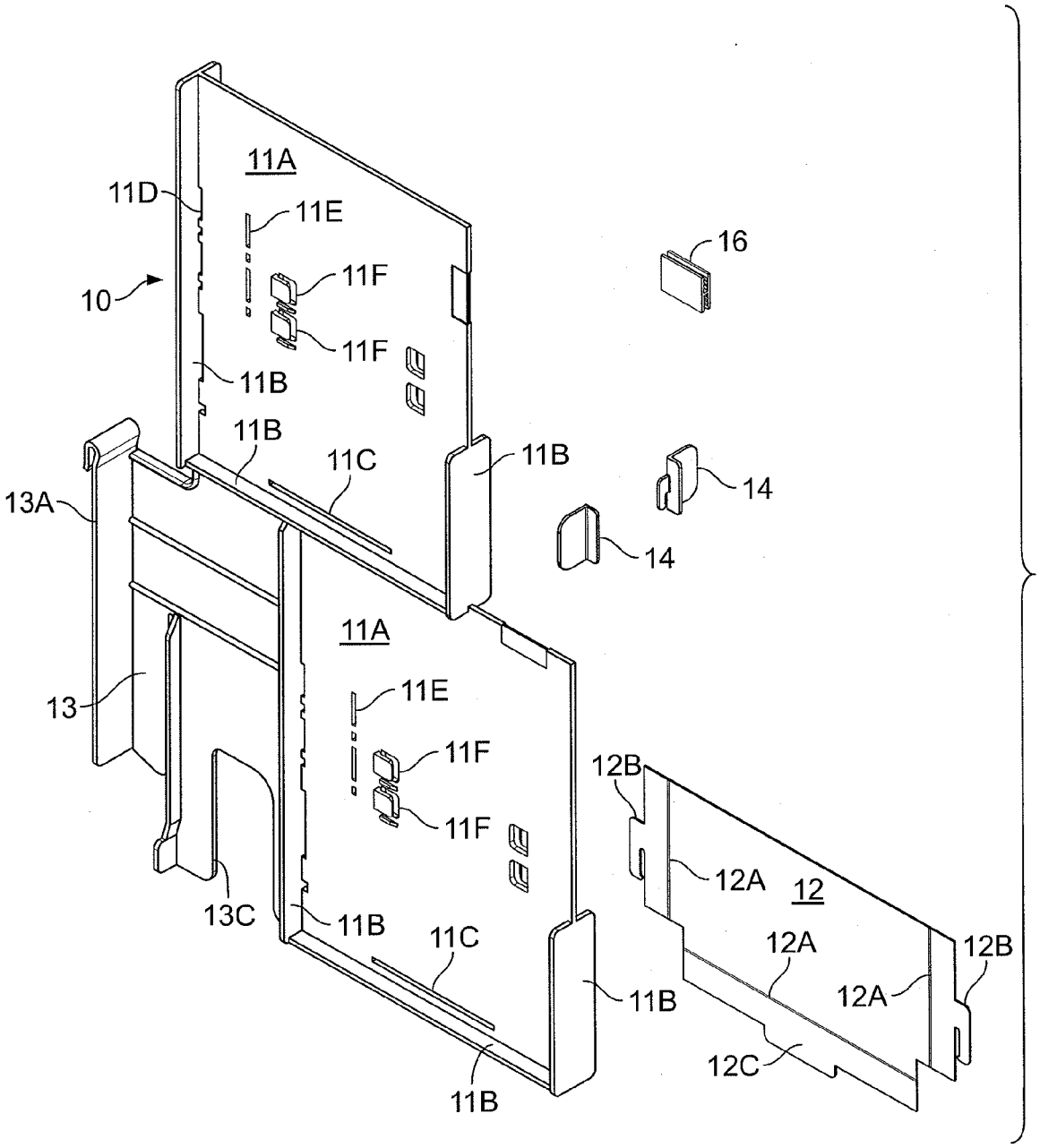
FIG. 7 is an exploded view of the greeting card highlighter of FIG. 1.

Additionally, the gripper channel 16 shown in FIG. 6 can be used to attach signage 18 or other advertisements to the main panel 10 of the greeting card highlighter 100 of the present invention. The gripper channel 16 is a small H-shaped piece having ridges contained on the inner surface thereof. Two grippers 16 may be used to hold a single sign 18 at the front of the greeting card highlighter 100. One gripper 16 may be attached to the top surface of the lower card backing panel 11A and one gripper 16 may be attached to the outer side surface of the upper card backing panel 11A, as shown in FIG. 1. The gripper channels 16 are optional components as they can be removed from the highlighter 100 if no sign or advertisement panel is desired.

While certain shapes, configurations, sizes and dimensions have been given with respect to a preferred embodiment, other shapes, configurations, sizes and dimensions may be used, have been contemplated and are considered to be within the scope of the present invention. It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A greeting card highlighter comprising:

a main panel having at least two integral double-sided card backing panels arranged in a staggered arrangement, and an attachment portion having at least two channels for attaching the greeting card highlighter to a larger tiered greeting card display;

at least two one-piece flexible card pockets which are removably attached to the at least two integral double-sided card backing panels;

wherein the attachment portion of the main panel is operative to fit over a first card pocket of a larger tiered greeting card display and into a second card pocket of a larger tiered greeting card display, the second card pocket being located at a lower vertical elevation than the first pocket, and wherein greeting cards can be held in the at least two one-piece flexible card pockets on both opposing front and back sides of said backing panels.

2. The greeting card highlighter of claim 1, wherein the at least two backing panels contain one horizontal slot and two vertical slots thereon for connection of the at least two flexible card pockets.

3. The greeting card highlighter of claim 1, wherein the at least two card backing panels contain at least one side-facing channel operative to hold re-order tickets or other flat planar material.

4. The greeting card highlighter of claim 1, wherein the at least two card backing panels contain at least two vertical openings thereon for insertion of a card divider.

5. The greeting card highlighter of claim 4 further comprising at least two removable card dividers inserted into the at least two vertical openings.

6. The greeting card highlighter of claim 1 further comprising at least two removable card dividers attached to each of the two card backing panels.

7. A greeting card highlighter comprising:

a main panel having two integral double-sided card backing panels thereon;

at least two card pockets removably attached to each side of the two integral double-sided card backing panels;

a downward facing u-shaped channel and a slot contained on the main panel;

wherein the downward facing u-shaped channel is operative to be inserted onto a first greeting card pocket located on a larger greeting card display and the slot is operative to be inserted into a second greeting card pocket located on a larger greeting card display below the first greeting card pocket.

8. The greeting card highlighter of claim 7, wherein the two integral double-sided card backing panels are arranged in a staggered arrangement.

9. The greeting card highlighter of claim 7, wherein one of the two integral double-sided card backing panels is located above and vertically offset from the other of the two integral double-sided card backing panels.

10. The greeting card highlighter of claim 7, wherein the two integral double-sided card backing panels contain two open-sided clips thereon for attaching merchandising materials thereto.

11. The greeting card highlighter of claim 7, wherein each of the two integral double-sided card backing panels contain a removable divider clip attached thereto.

12. The greeting card highlighter of claim 7 further comprising at least two gripper channels operative to hold signage or advertising.

13. A greeting card highlighter comprising:

a main panel having two integral double-sided card backing panels, one of the two integral double-sided card backing panels positioned above and vertically offset from the other integral double-sided card backing panels;

four card pockets, two card pockets removably attached to a first side of the main panel and two card pockets removably attached to a second side of the main panel, the first side of the main panel being opposite the second side of the main panel;

an attachment mechanism attached to the main panel, the attachment mechanism comprising at least one downward facing u-shaped channel operative to attached to a tiered greeting card display.

14. The greeting card highlighter of claim 13, wherein the attachment mechanism is located adjacent to one of the two integral double-sided card backing panels and below the other of the two double-sided card backing panels.

15. The greeting card highlighter of claim 13 further comprising four divider clips, each divider clip removably attached to each side of the two integral double-sided card backing panels.

16. The greeting card highlighter of claim 13 further comprising at least two gripper channels, one gripper channel attached to each of the two integral double-sided card backing panels.

17. The greeting card highlighter of claim 13, wherein the attachment mechanism can be inserted into a greeting card pocket of a tiered greeting card display.

* * * * *